US008833576B2

(12) United States Patent
Fontana

(10) Patent No.: US 8,833,576 B2
(45) Date of Patent: Sep. 16, 2014

(54) RE-CLOSABLE CONTAINER FOR FLUID PRODUCTS, PARTICULARLY FOR MEDICAL, PHARMACEUTICAL AND COSMETIC PRODUCTS

(75) Inventor: Antonio Fontana, Carpi (IT)

(73) Assignee: Lameplast S.p.A., Novi di Modena (IT)

( * ) Notice: Subject to any disclaimer, the term of this patent is extended or adjusted under 35 U.S.C. 154(b) by 0 days.

(21) Appl. No.: 13/701,545

(22) PCT Filed: Jul. 4, 2011

(86) PCT No.: PCT/IB2011/001556

§ 371 (c)(1),
(2), (4) Date: Jan. 10, 2013

(87) PCT Pub. No.: WO2012/014028

PCT Pub. Date: Feb. 2, 2012

(65) Prior Publication Data

US 2013/0098864 A1 Apr. 25, 2013

(30) Foreign Application Priority Data

Jul. 26, 2010 (IT) ..... MO2010A0213

(51) Int. Cl.

| | |
|---|---|
| ***B65D 1/09*** | (2006.01) |
| ***B65D 1/02*** | (2006.01) |
| ***A61J 1/14*** | (2006.01) |
| ***B65D 47/36*** | (2006.01) |
| ***A61J 1/18*** | (2006.01) |
| *A61J 1/06* | (2006.01) |

(52) U.S. Cl.

CPC ..... *B65D 47/36* (2013.01); *B65D 1/0246* (2013.01); *A61J 1/1412* (2013.01); *B65D 1/0238* (2013.01); *A61J 1/18* (2013.01); *A61J 2001/1418* (2013.01); *A61J 1/067* (2013.01); *B65D 1/095* (2013.01); *A61J 2001/1425* (2013.01); *Y10S 206/802* (2013.01)

USPC ..... 215/47; 215/48; 215/49; 215/50; 215/51; 215/250; 215/253; 222/94; 222/129; 222/541.1; 222/541.6; 206/802; 206/530; 206/532; 220/265; 220/266

(58) Field of Classification Search

CPC ..... B65D 1/09; B65D 1/08; B65D 1/095; B65D 47/36; B65D 77/22; A61J 1/067; B67D 7/74

USPC ..... D24/115, 112, 117; 222/129, 456, 94, 222/541.5, 541.6, 541.9; 206/802, 530, 206/532; 215/47, 48, 49, 50, 51, 250, 253, 215/252; 220/265, 266

See application file for complete search history.

(56) References Cited

U.S. PATENT DOCUMENTS

| | | | | | |
|---|---|---|---|---|---|
| 128,699 | A | * | 7/1872 | Bostwick | 222/173 |
| 1,575,231 | A | * | 3/1926 | Seltmann | 222/105 |
| 2,125,784 | A | * | 8/1938 | Higgins | 248/109 |
| 2,663,461 | A | * | 12/1953 | Brown | 222/107 |
| 2,977,014 | A | * | 3/1961 | Kock | 215/13.1 |
| 3,162,339 | A | * | 12/1964 | Lecluyse | 222/541.9 |
| 3,221,939 | A | * | 12/1965 | Brown | 222/94 |
| 3,366,289 | A | * | 1/1968 | Badavas et al. | 222/541.5 |
| 3,370,733 | A | * | 2/1968 | Giesler | 206/446 |
| 3,815,790 | A | * | 6/1974 | Allen et al. | 73/864.13 |
| 3,817,426 | A | * | 6/1974 | Fooks | 222/105 |
| 3,917,120 | A | * | 11/1975 | Larenz et al. | 222/129 |
| 3,949,871 | A | * | 4/1976 | Christensen et al. | 206/229 |
| 3,993,223 | A | * | 11/1976 | Welker et al. | 222/107 |
| 4,202,334 | A | * | 5/1980 | Elson | 604/415 |
| 4,469,254 | A | * | 9/1984 | Hansen | 222/207 |
| 4,502,616 | A | * | 3/1985 | Meierhoefer | 222/215 |
| 4,723,531 | A | * | 2/1988 | Hampton | 124/45 |
| 4,779,997 | A | * | 10/1988 | Schmidt | 383/96 |
| 4,790,453 | A | * | 12/1988 | Fontana et al. | 222/83 |
| 4,951,822 | A | * | 8/1990 | Fontana et al. | 206/530 |
| 5,065,966 | A | * | 11/1991 | Hartke | 248/146 |
| 5,076,452 | A | * | 12/1991 | Hashimoto | 215/48 |
| 5,188,250 | A | | 2/1993 | Kovacic et al. | |
| 5,200,153 | A | * | 4/1993 | Carr et al. | 422/550 |
| D348,830 | S | * | 7/1994 | Bertolini | D28/4 |
| 5,361,947 | A | * | 11/1994 | Lifshey | 222/212 |
| 5,577,636 | A | * | 11/1996 | Fukuoka et al. | 222/94 |
| 5,897,009 | A | * | 4/1999 | O'Meara | 215/48 |

| | | | | |
|---|---|---|---|---|
| 5,908,124 | A * | 6/1999 | Klauke et al. | 215/48 |
| 5,944,206 | A * | 8/1999 | Culter et al. | 215/48 |
| 6,095,374 | A * | 8/2000 | Ricard et al. | 222/173 |
| 6,116,449 | A * | 9/2000 | Chiesi et al. | 220/23.4 |
| 6,234,333 | B1 * | 5/2001 | Federighi et al. | 215/48 |
| D458,676 | S * | 6/2002 | Berglund et al. | D24/115 |
| D469,528 | S * | 1/2003 | Niermann et al. | D24/130 |
| D471,628 | S * | 3/2003 | Louviere | D24/115 |
| 6,543,655 | B1 * | 4/2003 | de Laforcade | 222/541.9 |
| 6,827,227 | B2 | 12/2004 | Fontana | |
| 6,874,665 | B2 * | 4/2005 | Doherty et al. | 222/541.5 |
| 6,880,730 | B2 * | 4/2005 | Fulwood | 222/186 |
| 6,991,140 | B2 * | 1/2006 | Bourque et al. | 222/541.9 |
| D547,860 | S * | 7/2007 | Zahn et al. | D9/696 |
| 7,540,389 | B2 * | 6/2009 | Fontana | 215/48 |
| D618,103 | S * | 6/2010 | Leventhal | D9/517 |
| 7,757,852 | B2 * | 7/2010 | Fontana | 206/463 |
| 7,810,680 | B2 * | 10/2010 | Stull et al. | 222/541.9 |
| 7,832,601 | B2 * | 11/2010 | Zahn et al. | 222/541.9 |
| 8,017,645 | B2 * | 9/2011 | Schmid | 514/419 |
| 8,047,394 | B2 * | 11/2011 | Hansen | 220/284 |
| D660,695 | S * | 5/2012 | Ishizawa et al. | D9/447 |
| 8,640,873 | B2 * | 2/2014 | Nakano et al. | 206/532 |
| 8,672,157 | B2 * | 3/2014 | Fontana | 215/291 |
| 2002/0100741 | A1 * | 8/2002 | Weiler | 215/48 |
| 2003/0155356 | A1 * | 8/2003 | Fontana | 220/23.4 |
| 2007/0007227 | A1 * | 1/2007 | Fontana | 215/48 |
| 2007/0228073 | A1 * | 10/2007 | Mazzarino | 222/107 |
| 2009/0321382 | A1 * | 12/2009 | Fontana | 215/329 |
| 2010/0032401 | A1 * | 2/2010 | Fontana | 215/235 |
| 2011/0082432 | A1 * | 4/2011 | Fontana | 604/310 |
| 2011/0132928 | A1 * | 6/2011 | Fontana | 222/94 |
| 2011/0186596 | A1 * | 8/2011 | Fontana | 222/94 |

FOREIGN PATENT DOCUMENTS

| | | | |
|---|---|---|---|
| EP | 1 289 842 | 3/2003 | |
| FR | 2 814 968 | 4/2002 | |
| GB | 1 446 300 | 8/1976 | |
| WO | 83/01052 | 3/1983 | |
| WO | 2008/117149 | 10/2008 | |
| WO | 2009/019527 | 2/2009 | |
| WO | 2010/013106 | 2/2010 | |
| WO | WO 2010084392 A1 * | 7/2010 | B65B 3/02 |

OTHER PUBLICATIONS

International Search Report dated Nov. 17, 2011, corresponding to PCT/IB2011/001556.

* cited by examiner

*Primary Examiner* — Mickey Yu
*Assistant Examiner* — Gideon Weinerth
(74) *Attorney, Agent, or Firm* — Young & Thompson

(57) ABSTRACT

The re-closable container (1) for fluid products, particularly for medical, pharmaceutical and cosmetic products, includes:

a hollow body (2) for containing a fluid product, which extends to a neck (4) having at least a dispensing mouth (5) for the product, and closing elements (7) for closing the dispensing mouth (5), which include:

a flat-plane gripping member (8), from which a shutter pin (9) of the dispensing mouth (5) extends substantially coplanar, an annular collar (12), which is associated with the flat-plane gripping member (8) along at least a pre-established breaking area (13) and which is rigidly associable with the neck (4), and a resting base (17) suitable for allowing the flat-plane gripping member (8) to rest on a supporting surface (18) in a resting configuration in which the shutter pin (9) remains lifted with respect to the supporting surface (18).

10 Claims, 3 Drawing Sheets

RE-CLOSABLE CONTAINER FOR FLUID PRODUCTS, PARTICULARLY FOR MEDICAL, PHARMACEUTICAL AND COSMETIC PRODUCTS

TECHNICAL FIELD

The present invention relates to a re-closable container for fluid products, particularly suitable for containing products used in the pharmaceutical and cosmetic field, or in the medical and dental one, but also in the food sector or the like.

BACKGROUND ART

The use is known of containers made of polymeric material for the packaging of one or more doses of fluid products, e.g. pastes, gel or liquids; depending on the number of doses, the known containers can be single-dose or re-closable and multi-dose type.

Generally, they comprise a containment body of a preset dose of product, with a substantially tubular and elongated shape, which has an extremity with a neck, at the top of which is defined a dispensing mouth for the product.

The opposite extremity of the containment body has an opening suitable for the introduction of the product, which is closed when filled, e.g., by sealing/welding.

Closing means, associable in a removable way with the container in correspondence to the neck, allow for the obstruction of the dispensing mouth. The containment body and the closing means can be made separately, by means of forming techniques such as injection moulding and then assembled together or, alternatively, can be made in a single body piece and then separated before use by a user.

The containment body has also a pair of fins which are suitable for make the gripping of the container easier by a user and which extend, on diametrically opposite sides, from the outer lateral surface of the containment body itself.

The known containers can be manufactured in single units or associated with one another in series (strip); in the latter case the fins of the containment bodies of two consecutive containers are temporarily associated with one another in correspondence to preset pre-breaking lines.

With particular reference to the closing means and their conformation depending on the different methods of use and manufacture, different types of container are known.

A first type of known containers foresees, e.g., the use of a hood having a portion fastened to the neck, during the moulding phase and along preset breaking areas, to obstruct the dispensing mouth.

The hood also comprises a recess suitable for housing the neck of the container, having a shutter element for shutting the dispensing mouth, and initially turned outwards, opposite the portion initially fastened to the neck.

The container is opened for the first time by removing the hood from the dispensing mouth in correspondence to the breaking areas and, following the use of the product, the container is re-closed by overturning the hood and fitting the neck into the recess, and through the positioning of the shutter element inside the dispensing mouth.

The particular shape of the hood leads however to the possible exposure of the recess and shutter element to external polluting agents before the first use of the container, not ensuring therefore the integrity of the product during next uses.

To reduce the possibility of product contamination, a second type of re-closable containers is known, made in a single body piece, which comprise closing means having a shutter element, of the pin type or the like, fitted sealed inside the dispensing mouth, and deformable or breakable elements which connect, without interruption, the closing means to the container body.

Such deformable or breakable elements are suitable for informing the user about the possible presence of product contamination due to any tampering and/or accidental opening of the product, having therefore a function of safety seals.

From document GB 1 446 300 a third type of containers is also known, wherein the closing means and the containment body are made in separate pieces, and assembled together afterwards.

The closing means of such containers consist of a cylindrical hollow body inside which are obtained a shutter element, of the type of a pin or the like, which can be fitted sealed inside the dispensing mouth, and an annular collar which can be fastened by interlocking on the neck of the containment body.

The annular collar is associated in a removable way in correspondence to the inner surface of the cylindrical plug by means of a suitable weakened area, made up, e.g. of pre-breaking lines, breakable bridges, reduced cross sections or the like.

The cylindrical plug, the annular collar and the pin are therefore made in a single body piece, separately from the containment body, and the collar is subsequently fastened to the neck by interlocking with closure of the dispensing mouth by means of the pin.

A simplified and much easier version of such third type of container for manufacturing purposes is shown in the document EP 1 289 842.

This document, in actual facts, illustrates the use of a re-closable container wherein the containment body and the closing means are still made in two separate pieces, but with the difference that the cylindrical plug is replaced by a flat-plane gripping element supporting the shutter pin and the annular collar.

The container shown in EP 1 289 842 is also susceptible to further upgrading.

In this respect the fact is underlined that, during use, the user opens the container by removing the shutter pin and seizing the flat-plane element and, to handle the containment body in a practical and easy way during the dispensing of the fluid product, usually puts the flat-plane gripping element temporarily on a supporting surface (a shelf, a table, the edge of a washbasin, etc.).

Once the operation is finished, the flat-plane gripping element is fitted again into the dispensing mouth to close the container.

During the resting phase on the supporting surface, however, the shutter pin enters inevitably into contact with the surface itself, with the risk of being contaminated by microbes and bacteria and, once fitted in the dispensing mouth, of contaminating also the remaining fluid product in the container, which is intended for subsequent uses.

Such circumstance occurs because the flat-plane gripping element has a particularly reduced thickness, to allow the injection moulding in a practical and cheap way, and can be laid on the supporting surface only horizontally, with the shutter pin which inconveniently touches the supporting surface.

DESCRIPTION OF THE INVENTION

The main aim of the present invention is to provide a container for fluid products, particularly for medical, pharmaceutical and cosmetic products, which can be used in a practical, easy and functional way, which has overall dimensions particularly reduced and which, during use, does not have any risk of contamination of the fluid product by microbes and bacteria.

Another object of the present invention is to provide a container for fluid products, particularly for medical, pharmaceutical and cosmetic products, that allows to overcome the mentioned drawbacks of the state of the art in the ambit of a simple, rational, easy and effective to use as well as low cost solution.

The above objects are achieved by the present re-closable container for fluid products, particularly for medical, pharmaceutical and cosmetic products, comprising:

at least a hollow body for containing at least a fluid product, which extends to at least a neck having at least a dispensing mouth for dispensing said product, and closing means for closing said dispensing mouth, which comprise:

at least a flat-plane gripping element, from which at least a shutter pin for shutting said dispensing mouth extends substantially coplanar, and at least an annular collar, which is associated with said flat-plane gripping element along at least a pre-established breaking area and which is rigidly associable with said neck, characterised by the fact that said closing means comprise at least a resting base suitable for allowing said flat-plane gripping element to rest on a supporting surface in a resting configuration in which said shutter pin remains lifted with respect to said supporting surface.

BRIEF DESCRIPTION OF THE DRAWINGS

Other characteristics and advantages of the present invention will become more evident from the description of a preferred, but not sole, embodiment of a re-closable container for fluid products, particularly for medical, pharmaceutical and cosmetic products, illustrated purely as an example but not limited to the annexed drawings in which.

EMBODIMENTS OF THE INVENTION

With particular reference to such figures, globally indicated by 1 is a re-closable container for fluid products, particularly for medical, pharmaceutical and cosmetic products.

In this respect, it must be pointed out that in the present treatise the term fluid products means not only liquid products but also viscous products, e.g. in the state of paste and gel, and powder products, in particular very fine powders with great flowability.

The container 1 comprises a hollow body 2 which is designed to contain a fluid product.

Figure 1:
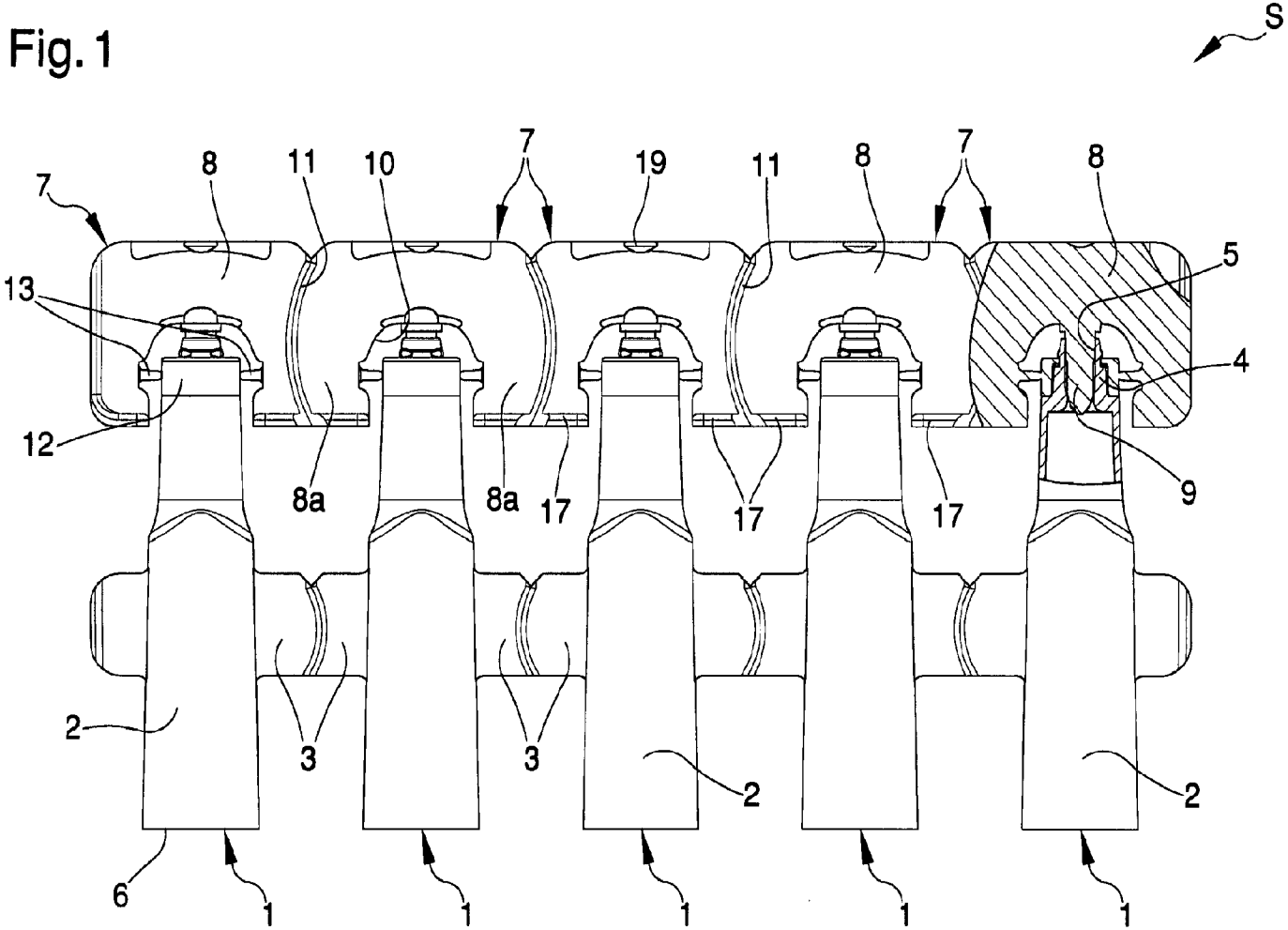
FIG. 1 is a front, partially in section, view of a strip of containers according to the invention.

The hollow body 2 has a substantially tubular and elongated shape on the outer surface of which is defined a pair of gripping fins 3 associable in a removable way with the gripping fins 3 of one or more adjacent containers 1, so as to form a strip S of containers 1 (FIG. 1).

An extremity of the hollow body 2 extends to a neck 4 having a dispensing mouth 5 for the outflow of the fluid product.

The neck 4 is substantially cylindrical, with a smaller diameter than the rest of the hollow body 2, and is aligned coaxial to it.

In correspondence to the extremity of the hollow body 2 opposite the neck 4 is defined an opening 6 for the introduction of the fluid product; the closing of the opening 6 (e.g. by sealing of the lips of the opening itself) is made only after the product has been introduced.

The closing of the dispensing mouth 5, on the other hand, is made by means of special closing means 7 comprising a flat-plane gripping element 8.

A shutter pin 9 extends from the flat-plane gripping element 8 and is substantially coplanar with respect to it.

The shutter pin 9 can be fitted into the dispensing mouth 5.

In such regard it must be underlined that, when in the present treatise it is said that the shutter pin 9 is coplanar to the flat-plane gripping element 8, this means that their resting plane is substantially the same; on the contrary, when a part of the present container 1 is defined by the adjective "transversal", it is then meant that this part extends at least in part in an oblique direction or in a direction at right angles to the resting plane on which the flat-plane gripping element 8 rests. The flat-plane gripping element 8 has a substantially flat shape with two portions 8*a* which protrude on opposite sides of the shutter pin 9.

In other words the flat-plane gripping element 8 is shaped so as to define a recess 10 obtained between the two portions 8*a*, and inside the recess 10 the shutter pin 9 extends overhanging.

The flat-plane gripping element 8 has two opposite sides 11 which, in the conformation of strip S shown in FIG. 1, are associated with the flat-plane gripping elements 8 of one or more adjacent containers 1.

The closing means 7, moreover, comprise an annular collar 12, which is associated with the flat-plane gripping element 8 along a series of pre-established breaking areas 13.

The pre-established breaking areas 13 are made up of, e.g., a pair of breakable bridges which connect the portions 8*a* to the outer surface of the collar 12 and which are arranged on diametrically opposite sides of the collar 12.

The collar 12 can be fitted around the neck 4 and is intended to be made integrally with it.

In the particular embodiment of the invention shown in the figures, e.g., interlocking coupling means 14, 15, 16 are placed between the neck 4 and the collar 12.

In particular, the interlocking coupling means 14, 15, 16 comprise a fastening tooth 14 defined on the outer surface of the neck 4 and which can be coupled to the inner edge of the collar 12 to prevent its moving away from the hollow body 2.

Similarly, the interlocking coupling means 14, 15, 16 comprise anti-rotation means which prevent the collar 12 from rotating around the neck 4 and which, e.g., consist in a pair of longitudinal grooves 15 obtained in the collar 12 and which can be coupled with the same number of longitudinal projections 16 defined on the outer surface of the neck 4.

Alternative embodiments of the present invention are however possible wherein the collar 12 is made integral to the neck 4 by sealing/welding, e.g. of the hot or ultra-sound type, or by gluing.

It must also be pointed out that the flat-plane gripping element 8, the shutter pin 9 and the collar 12 are made in a single body piece, e.g. by means of forming techniques such as injection moulding, by using polymeric materials, of the polyethylene or polypropylene type.

Similarly, the hollow body 2 can also be obtained through the same forming techniques as the closing means 7 inside a separate mould.

Figure 2:
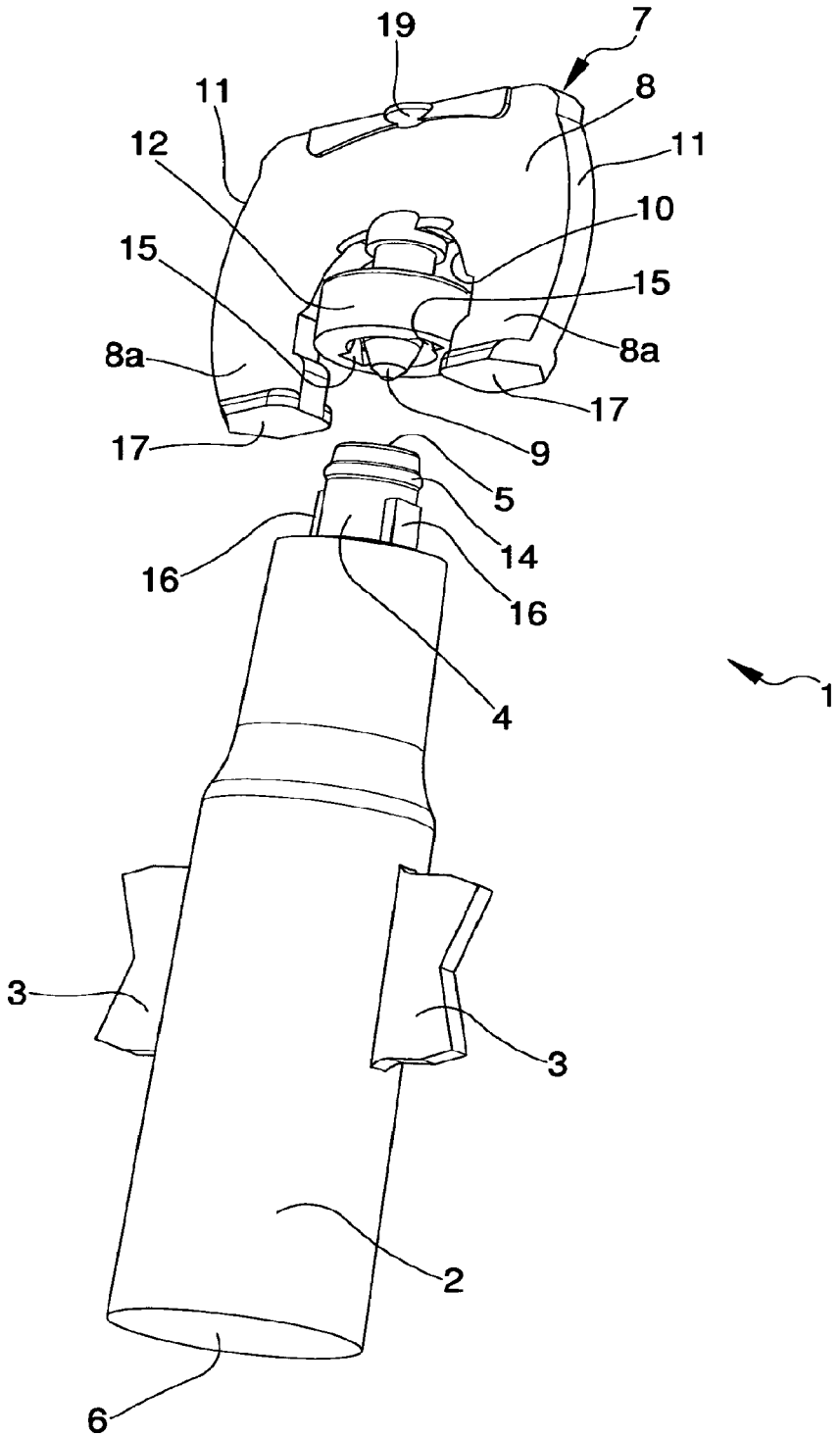
FIG. 2 is an exploded view of a container according to the invention before assembly.

The hollow body 2 is therefore initially separated from the closing means 7, as shown in FIG. 2, and the container 1 is assembled in a second phase by fitting the collar 12 on the neck 4 with fitting at the same time the shutter pin 9 into the dispensing mouth 5.

When using the first time, the shutter pin 9 is removed from the dispensing mouth 5 while the collar 12, after the breaking of the breakable bridges 13, remains fitted on the neck 4 with a "tamper-evident" function to demonstrate that opening has occurred.

Figure 3:
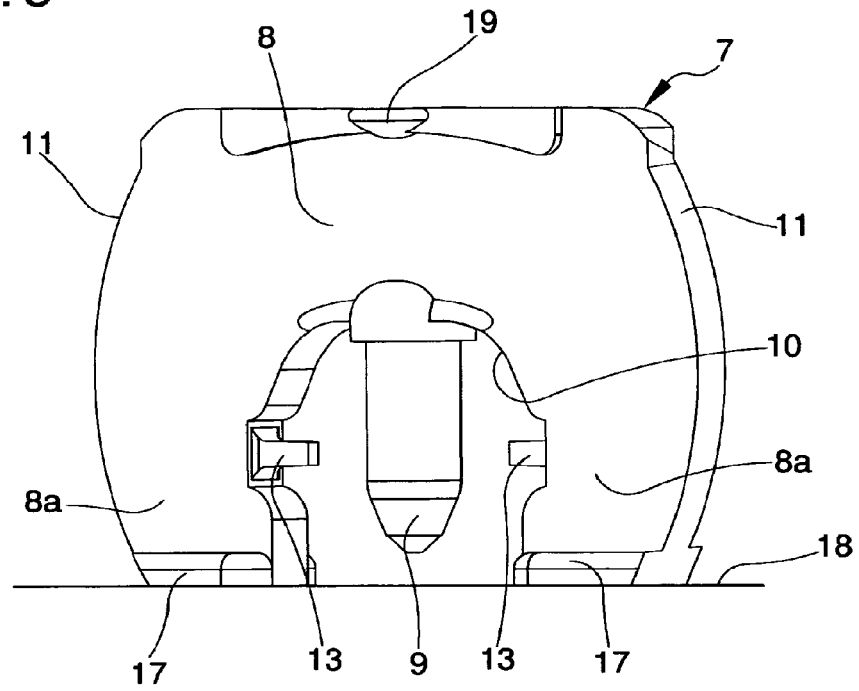
FIG. 3 is an axonometric view of the flat-plane gripping element according to the invention in a resting configuration.

Advantageously, the closing means 7 comprise a resting base 17 suitable for allowing the resting of the flat-plane gripping element 8 on a general supporting surface 18 in a resting configuration wherein the shutter pin 9 remains lifted with respect to the supporting surface 18 (FIG. 3).

In particular, in the resting configuration, the flat-plane gripping element 8 is substantially vertical, with the shutter pin 9 arranged vertically and turned downwards.

The resting base 17, in actual facts, consists in a pair of cross feet obtained along the peripheral sides of the portions 8*a* of the flat-plane gripping element 8 which, in a closing configuration, are turned towards the hollow body 2.

Usefully, the transversal overall dimensions of the cross feet 17, i.e. those measured in a direction substantially at right angles to the resting plane of the flat-plane gripping element 8, are substantially bigger than the transversal overall dimensions of the shutter pin 9.

This allows to ensure the removal of the shutter pin 9 from the supporting surface 18 also in the case of the flat-plane gripping element 8 not being correctly positioned in the resting configuration of FIG. 3 or that, after the positioning in the resting configuration, it is made to fall down by mistake.

In such respect it is underlined that the closing means 7 comprise an auxiliary resting edge 19 arranged substantially opposite the cross feet 17.

Figure 4:
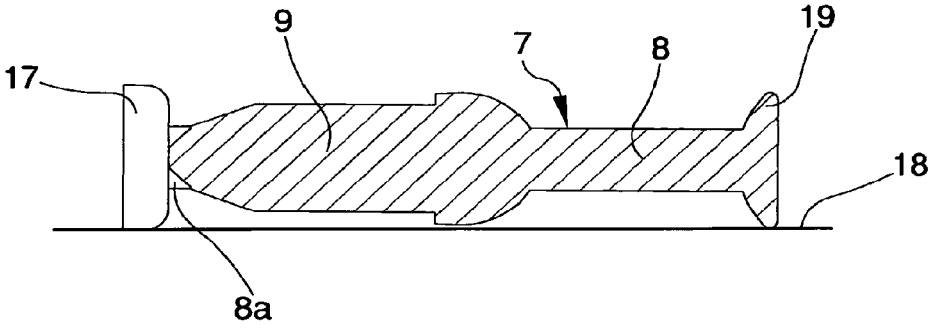
FIG. 4 is a section view of the flat-plane gripping element according to the invention in a laid-down configuration.

The auxiliary resting edge 19 is suitable for cooperating with the resting base 17 to allow the flat-plane gripping element 8 to rest on the supporting surface 18 in a laid-down configuration in which the flat-plane gripping element 8 is arranged substantially horizontal and the shutter pin 9 remains lifted with respect to the supporting surface 18 (FIG. 4).

It has in point of fact been ascertained how the described invention achieves the proposed objects.

In this respect the fact is underlined that the container according to the invention can be opened easily and, if required, re-closed without the risk of jeopardising the sterility of the fluid product inside it.

It is also underlined that the particular device of providing closing means such as those previously described and illustrated, allows to have a flat-plane gripping element which may stand without the need for the shutter pin of entering into contact with the supporting surface and, therefore, without the risk of being contaminated by microbes and bacteria.

The invention claimed is:

1. Re-closable container (1) for fluid products, comprising:

a hollow body (2) for containing at least a fluid product, which extends to a neck (4) having a dispensing mouth (5) for dispensing said product, and closing means (7) for closing said dispensing mouth (5), which comprise:

a flat-plane sheet shaped gripping element (8), from which a shutter pin (9) for shutting said dispensing mouth (5) extends substantially coplanar, said flat-plane sheet shaped gripping element (8) comprising at least two coplanar portions (8*a*) which extend on opposite sides of said shutter pin (9), said flat-plane sheet shaped gripping element (8) being shaped so as to define a recess (10) between said two coplanar portions (8*a*) and inside which said shutter pin (9) extends overhanging, an annular collar (12), which is associated with said flat-plane sheet shaped gripping element (8) along at least a pre-established breaking area (13) and which is rigidly associable with said neck (4), and a resting base (17) arranged to permit said flat-plane sheet shaped gripping element (8) to rest on a supporting surface (18) in a resting configuration in which said shutter pin (9) is spaced from said supporting surface (18) and is substantially vertical and is turned downwards, said resting base (17) comprising at least a cross foot along the peripheral side of said two coplanar portions (8*a*) which, in closing configuration, is turned towards said hollow body (2), wherein transversal overall dimensions of said shutter pin are larger than transversal overall dimensions of said flat-plane sheet and wherein transversal overall dimensions of said cross foot are larger than transversal overall dimensions of said shutter pin.

2. Container (1) according to claim 1, wherein said closing means (7) comprise at least an auxiliary resting edge (19) arranged substantially opposite said resting base (17) and suitable for cooperating with said resting base (17) to allow said flat-plane sheet shaped gripping element (8) to rest on said supporting surface (18) in a laid-down configuration in which said flat-plane sheet shaped gripping element (8) is arranged substantially horizontal and said shutter pin (9) remains lifted with respect to said supporting surface (18).

3. Container (1) according to claim 1, further comprising interlocking coupling means (14, 15, 16) of said collar (12) to said neck (4).

4. Container (1) according to claim 1, wherein said collar (12) is associable with said neck (4) by sealing/welding.

5. Container (1) according to claim 1, wherein said collar (12) is associable with said neck (4) by gluing.

6. Container (1) according to claim 1, wherein said pre-established breaking area (13) comprises at least a pair of breakable bridges which connect said two coplanar portions (8*a*) of the flat-plane sheet shaped gripping element (8) to the outer side surface of said collar (12).

7. Container (1) according to claim 1, wherein said flat-plane sheet shaped gripping element (8), said shutter pin (9) and said collar (12) are made in a single body piece.

8. Container (1) according to claim 1, wherein said flat-plane sheet shaped gripping element (8) is associable with the flat-plane sheet shaped gripping element (8) of an adjacent container (1) to form a strip (S) of said containers (1).

9. Container (1) according to claim 1, wherein said hollow body (2) comprises at least a gripping fin (3) associable in a removable way with the gripping fin (3) of an adjacent container (1) to form a strip (S) of said containers (1).

10. A re-closable container for fluid products, comprising:

a hollow body with a mouth for dispensing a fluid product; and a cap for closing said dispensing mouth, said cap comprising, a gripping element having two coplanar portions with a recess therebetween, a shutter pin for shutting said dispensing mouth, said shutter pin depending from said gripping element in said recess between said two coplanar portions and having a longitudinal axis in a plane of said two coplanar portions, an annular collar that is associated with said gripping element along a pre-established breaking area and which is associable with said hollow body, and a resting base arranged to permit said gripping element to rest on a supporting surface in a resting configuration in which said shutter pin is spaced from the supporting surface and is substantially perpendicular to the supporting surface, said resting base comprising cross feet along opposite sides of at least one of said two coplanar portions, said cross feet extending transverse to the plane of said two coplanar portions further than said shutter pin extends transverse to the plane of said two coplanar portions.

* * * * *